US010670194B2

(12) United States Patent
Vissenberg et al.

(10) Patent No.: US 10,670,194 B2
(45) Date of Patent: Jun. 2, 2020

(54) SSL LAMP THAT INCLUDES THREE OR MORE CROSSED ELONGATED LIGHT EMITTING STRUCTURES

(71) Applicant: SIGNIFY HOLDING B.V., Eindhoven (NL)

(72) Inventors: Michel Cornelis Josephus Marie Vissenberg, Roermond (NL); Malgorzata Perz, Eindhoven (NL); Dragan Sekulovski, Eindhoven (NL); Willem Lubertus Ijzerman, Oss (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/336,139

(22) PCT Filed: Dec. 18, 2017

(86) PCT No.: PCT/EP2017/083241
§ 371 (c)(1),
(2) Date: Mar. 25, 2019

(87) PCT Pub. No.: WO2018/127391
PCT Pub. Date: Jul. 12, 2018

(65) Prior Publication Data

US 2019/0316740 A1 Oct. 17, 2019

(30) Foreign Application Priority Data

Jan. 5, 2017 (EP) ..... 17150411

(51) Int. Cl.
*F21K 9/232* (2016.01)
*F21K 9/65* (2016.01)
*F21Y 103/20* (2016.01)

(52) U.S. Cl.
CPC ..... *F21K 9/232* (2016.08); *F21K 9/65* (2016.08); *F21Y 2103/20* (2016.08)

(58) Field of Classification Search
CPC ..... F21K 9/232; F21K 6/232; F21K 9/65
See application file for complete search history.

(56) References Cited

U.S. PATENT DOCUMENTS

| | | | |
|---|---|---|---|
| 2014/0043845 | A1 | 2/2014 | Chen et al. |
| 2014/0268802 | A1 | 9/2014 | Sun et al. |

FOREIGN PATENT DOCUMENTS

| | | | |
|---|---|---|---|
| CN | 103460093 | A | 12/2013 |
| CN | 203797384 | U | 8/2014 |
| CN | 203848062 | U | 9/2014 |
| CN | 104676322 | A | 6/2015 |
| CN | 204437756 | U | 7/2015 |
| CN | 204693112 | U | 10/2015 |
| CN | 204717433 | U | 10/2015 |

(Continued)

*Primary Examiner* — Joseph L Williams
(74) *Attorney, Agent, or Firm* — Daniel J. Piotrowski

(57) ABSTRACT

Disclosed is a SSL lamp that includes three or more elongated light emitting structures. A respective first end of each of the three or more elongated light emitting structures are arranged such that they define a first polygon. A portion of each of the three or more elongated light emitting structures are arranged in vicinity of each other such that the three or more elongated light emitting structures crosses each other at a smallest angle of at least 30 degrees, thereby forming a common neck.

13 Claims, 3 Drawing Sheets

(56) References Cited

FOREIGN PATENT DOCUMENTS

| | | | | |
|---|---|---|---|---|
| CN | 205065343 | U | 3/2016 | |
| CN | 205535146 | U | 8/2016 | |
| CN | 105927872 | A | 9/2016 | |
| JP | 3205545 | U | 7/2016 | |
| JP | 2016528711 | A | 9/2016 | |
| WO | WO-9103831 | A1 * | 3/1991 | ..... H01J 1/16 |
| WO | 2010110652 | A1 | 9/2010 | |
| WO | 2013099074 | A | 7/2013 | |
| WO | 2015096280 | A1 | 7/2015 | |
| WO | 2016150230 | A1 | 9/2016 | |

* cited by examiner

SSL LAMP THAT INCLUDES THREE OR MORE CROSSED ELONGATED LIGHT EMITTING STRUCTURES

CROSS-REFERENCE TO PRIOR APPLICATIONS

This application is the U.S. National Phase application under 35 U.S.C. § 371 of International Application No. PCT/EP2017/083241, filed on Dec. 18, 2017, which claims the benefit of European Patent Application No. 17150411.1 filed on Jan. 5, 2017. These applications are hereby incorporated by reference herein.

FIELD OF THE INVENTION

The present invention generally relates to a SSL lamp comprising three or more elongated light emitting structures.

BACKGROUND OF THE INVENTION

A global need and desire for a reduced use of energy and in particular electricity has rapidly advanced the development of more energy efficient light lamps or sources. Lamps based on solid state light sources, so called solid state lighting lamps, SSL lamps, are constantly receiving more and more attention due to the low energy consumption compared to traditional incandescent light sources. Typical examples of SSL lamps are light sources based on different types of light emitting diodes, LEDs. Such light sources are commonly referred to as LED lamps or SSL lamps. SSL lamps are becoming increasingly more energy efficient while the light flux from a typical SSL lamp is increasing. The increased light flux and low energy consumption allows for that SSL lamps are used for constantly growing number of applications.

Although SSL lamps offer significant advantages as compared to traditional incandescent lamps in many aspects, the appearance and light distribution is generally considered as less attractive due to several reasons. A SSL lamp typically emits a bright directional light. Light emitted from a SSL lamp is often perceived as cold and less decorative due to the high color temperature of the light and the typical directionality. For this reason, there are many SSL lamps available aiming at producing an omnidirectional light flux with a light having a relatively speaking lower color temperature. Such SSL lamps are in other words in some respects trying to resemble or mimic the appearance of a traditional incandescent lamp.

A traditional incandescent lamp generally has a thin filament which is heated to an elevated temperature, thereby providing a light when glowing or burning. The light emitted from a traditional incandescent lamp generally has a lower color temperature as compared to a typical SSL light source. Also the omnidirectionality is generally not considered a problem. The typical characteristics of a traditional incandescent lamp is therefore commonly perceived as being warm and decorative as compared to SSL lamps based on LED or laser light sources.

Various technical solutions for SSL lamps exist, aiming at trying to mimic the appearance of a traditional incandescent lamp. Generally, these technical solutions tend to become glary, a problem which becomes increasingly pronounced in case the SSL lamp in questions is employed with a transparent bulb. The use of a transparent bulb is common for so called clear candles and bulbs where the lamp is expected to be viewed directly by a user. The glary nature of the SSL lamps typically inhibits the use of the otherwise attractive SSL lamps in e.g. decorative applications, where the lamp is expected to be viewed directly.

Hence, there is a need for an improved SSL lamp.

SUMMARY OF THE INVENTION

According to an aspect of the invention, the above is at least partly alleviated by a SSL lamp comprising: three or more elongated light emitting structures, wherein a respective first end of each of the three or more elongated light emitting structures are arranged such that they define a first polygon, and wherein a portion of each of the three or more elongated light emitting structures are arranged in vicinity of each other such that the three or more elongated light emitting structures crosses each other at a smallest angle of at least 30 degrees, thereby forming a common neck.

By means of the present invention an improved SSL lamp is achieved. The SSL lamp emits light having a relatively speaking even light distribution allowing for that the SSL lamp may be used in various applications intended for traditional incandescent lamps. In other words, the SSL lamp emits light having a light distribution mimicking a traditional incandescent lamp, which results in that the SSL lamp may be used as a retrofit to replace traditional incandescent lamps or in specific tailor-made applications.

Further, the fact that the SSL lamp emits light from three or more elongated light emitting structures being arranged in vicinity of each other such that the three or more elongated light emitting structures crosses each other at a smallest angle of at least 30 degrees while forming a common neck results in that the SSL lamp produces a sparkling effect. More specifically, since the light emitting structures crosses each other at a smallest angle of at least 30 degrees in a fashion were a common neck is formed, a pronounced sparkling effect is achieved. In general, a sparkling effect is appreciated by a person viewing a lamp. At the same time a lamp having the above sparkling effect is generally considered as less glary. In other words, the SSL lamp will generally be considered as less glary and more sparkly when the three or more elongated light emitting structures crosses each other at a smallest angle of at least 30 degrees while forming a common neck. This arrangement, thus renders the SSL lamp attractive and suitable for decorative applications where the SSL lamp is expected to be viewed directly by a user.

The appreciated sparkling effect is generally stronger when a user is able to see what can be considered a true cross of light emitting structures, owing from the nature of the human eye and the perception of the user. In other words, the appreciated sparkling effect is generally achieved when light emitting structures crosses each other at a relatively speaking large smallest angle, such as at least 30 degrees.

It should be noted that within the context of this application the term "light emitting structure" may be any type of structure, active or passive which may emit light. The light emitting structure may generate light which is emitted from the structure. The light emitting structure may receive and conduct or guide light being generated external of the structure, which conducted light is then emitted from the structure. The light emitting structure may comprise a LED element generating light. Further, the light emitting structure may comprise an organic light emitting diode, OLED, a polymer light emitting diode, PLED, or a solid state laser generating light. The light emitting element may be a translucent element comprising a rough surface for scattering light. Further, light impinging on the light emitting structure may be transported within the structure and subsequently scattered and emitted at a different location of the structure. A solid state laser, such as a laser diode, may advantageously be used in combination with a structure for transporting and scattering light. The light emitting structure may thus be made of a translucent material which allows for that light may be transported within the structure, or the light emitting structure may not be able to transport light within the structure. The light emitting structure may comprise active portions, generating light, and passive portions, receiving and emitting light.

It should be noted that within the context of this application the term "elongated light emitting structure" may be any type of light emitting structure having a length of at least three times a width.

It should be noted that within the context of this application the term "arranged in vicinity of each other" may refer to any smallest distance between any of the elongated light emitting structures not exceeding two times a largest cross section of any of the elongated light emitting structures. In other words, the distance between any two elongated light emitting structures being located closest to each other may not exceed two times the cross section of the respective elongated light emitting structures. The three or more elongated light emitting structures may be arranged such that the smallest distances between the three or more elongated light emitting structures are equal, as for example when the three or more elongated light emitting structures are symmetrically arranged.

It should be noted that within the context of this application the term "common neck" may refer to any physical arrangement, where the three or more elongated light emitting structures are arranged such that they are arranged in vicinity of each other at common location, thereby forming a distinct smallest cross section of a volume defined by the three or more elongated light emitting structures. In other words, the common neck is defined by a minimum cross section of an arrangement comprising elongated light emitting structures. The neck may hence be formed at any point along a longitudinal extension of the respective elongated light emitting structures, as the common neck is solely defined by the arrangement of the respective elongated light emitting structures and not the shape and size of the respective elongated light emitting structures. The three or more elongated light emitting structures may typically be arranged so as to define a volume resembling an hourglass, where two bulblike volumes are connected by a narrow neck, the common neck. In case three elongated light emitting structures are used a tripod configuration is thus achieved, and in case four elongated light emitting structures are used a quadrupod configuration is thus achieved.

It should be noted that within the context of this application the term "smallest angle of at least 30 degrees" may be any smallest angle when an elongated light emitting structure crosses another elongated light emitting structure. More specifically, two angles are defined when two light emitting structures are crossing each other. The angles so defined, together amounts to 180 degrees, i.e. the sum of the angles is 180 degrees. Hence, a projection of an elongated light emitting structure in a normal direction of a longitudinal axis thereof crosses another elongated light emitting structure such that the smallest angle defined is equal to or exceeds 30 degrees. In other words, a distinct cross is formed by the light emitting structures crossing each other.

In an embodiment of the invention, at least one of the three or more elongated light emitting structures may be an active light emitting structure in the form of an elongated LED filament. By this arrangement, light may be generated by at least one of the three or more elongated light emitting structures, while light is received and transported within the other elongated light emitting structures and subsequently scattered and emitted at a different location of the structure. A sparkling effect may thus be achieved in a simple and yet effective manner, while producing an even light distribution.

It should be noted that within the context of this application the term "LED filament" may be any type of LED light source aiming at mimicking an incandescent filament to some extent. A general LED filament comprises a series of LED elements on a transparent substrate, generally made of glass or sapphire. The substrate and LED elements are generally covered with a phosphor comprising coating used to convert the light emitted by the LED into light having desired properties. Generally, blue light is emitted from the LED elements and converted into a mixture of red, green and blue light. By this arrangement the color temperature of the light emitted by the LED filament may be tailored.

It should be noted that within the context of this application the term "elongated LED filament" may be any type of LED filament having a length of at least three times a width.

In an embodiment of the invention, at least one of the three or more elongated light emitting structures may be an active light emitting structure in the form of an elongated light emitting structure comprising a solid state laser. By this arrangement, light may be generated by at least one of the three or more elongated light emitting structures, while light is received and transported within the other elongated light emitting structures and subsequently scattered and emitted at a different location of the structure. A sparkling effect may thus be achieved in a simple and yet effective manner, while producing an even light distribution.

In an embodiment of the invention, at least one of the three or more elongated light emitting structures may be a passive light emitting structure in the form of an elongated light scattering feature, which is advantageous in that a sparkling effect may be achieved in a simple and yet effective manner, while producing an even light distribution. Further, the use of passive light emitting structures may allow for a simplified manufacturing using a reduced number of electrical connections and electronic components.

In an embodiment of the invention, the three or more elongated light emitting structures may be active light emitting structures in the form of elongated LED filaments, which is advantageous in that a distinct sparkling effect may be achieved while producing an even light distribution.

In an embodiment of the invention, a respective second end of each of the three or more elongated light emitting structures may be arranged such that they define a second polygon, the first and second polygons being rotated relative each other. By this arrangement, a sparkling effect and an even light distribution may be achieved.

In an embodiment of the invention, the first polygon and the second polygon may be of equal shape, which is advantageous in that a symmetric arrangement of the three or more elongated light emitting structures may be realized, resulting in an even light distribution.

In an embodiment of the invention, the first polygon and the second polygon may be of equal size, which is advantageous in that a symmetric arrangement of the three or more elongated light emitting structures may be realized, resulting in an even light distribution.

In an embodiment of the invention, each of the three or more elongated light emitting structures may be arranged with a corresponding angle with respect to a normal direction of the first polygon, which is advantageous in that a symmetric arrangement of the three or more elongated light emitting structures may be realized, resulting in an even light distribution.

In an embodiment of the invention, three elongated light emitting structures may be arranged in a tripod configuration.

In an embodiment of the invention, four elongated light emitting structures may be arranged in a quadrupod configuration.

In an embodiment of the invention, the SSL lamp may comprise a transparent bulb configured to at least partially enclose the three or more elongated light emitting structures. By this arrangement, the three or more elongated light emitting structures may be protected from the ambient. Moreover, the use of a transparent bulb simplifies handling of the SSL lamp and reduces the risk of electrical chock or short-circuit.

In an embodiment of the invention, the transparent bulb may comprise an opening through which the first polygon fits, which is advantageous in that the three or more elongated light emitting structures may be arranged in their intended positions and electrically connected before being inserted into the bulb.

In an embodiment of the invention, the transparent bulb may comprise an opening through which the second polygon fits, which is advantageous in that the three or more elongated light emitting structures may be arranged in their intended positions and electrically connected before being inserted into the bulb.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the device described as such device may vary. It is also to be understood that the terminology used herein is for purpose of describing particular embodiments only, and is not intended to be limiting. It must be noted that, as used in the specification and the appended claim, the articles "a," "an," "the," and "said" are intended to mean that there are one or more of the elements unless the context clearly dictates otherwise. Thus, for example, reference to "a unit" or "the unit" may include several devices, and the like. Furthermore, the words "comprising", "including", "containing" and similar wordings does not exclude other elements or steps.

BRIEF DESCRIPTION OF THE DRAWINGS

The above and other aspects of the present invention will now be described in more detail, with reference to the appended drawings showing embodiments of the invention. The figures should not be considered limiting the invention to the specific embodiment; instead they are used for explaining and understanding the invention.

As illustrated in the figures, the sizes of layers and regions are exaggerated for illustrative purposes and, thus, are provided to illustrate the general structures of embodiments of the present invention. Like reference numerals refer to like elements throughout.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
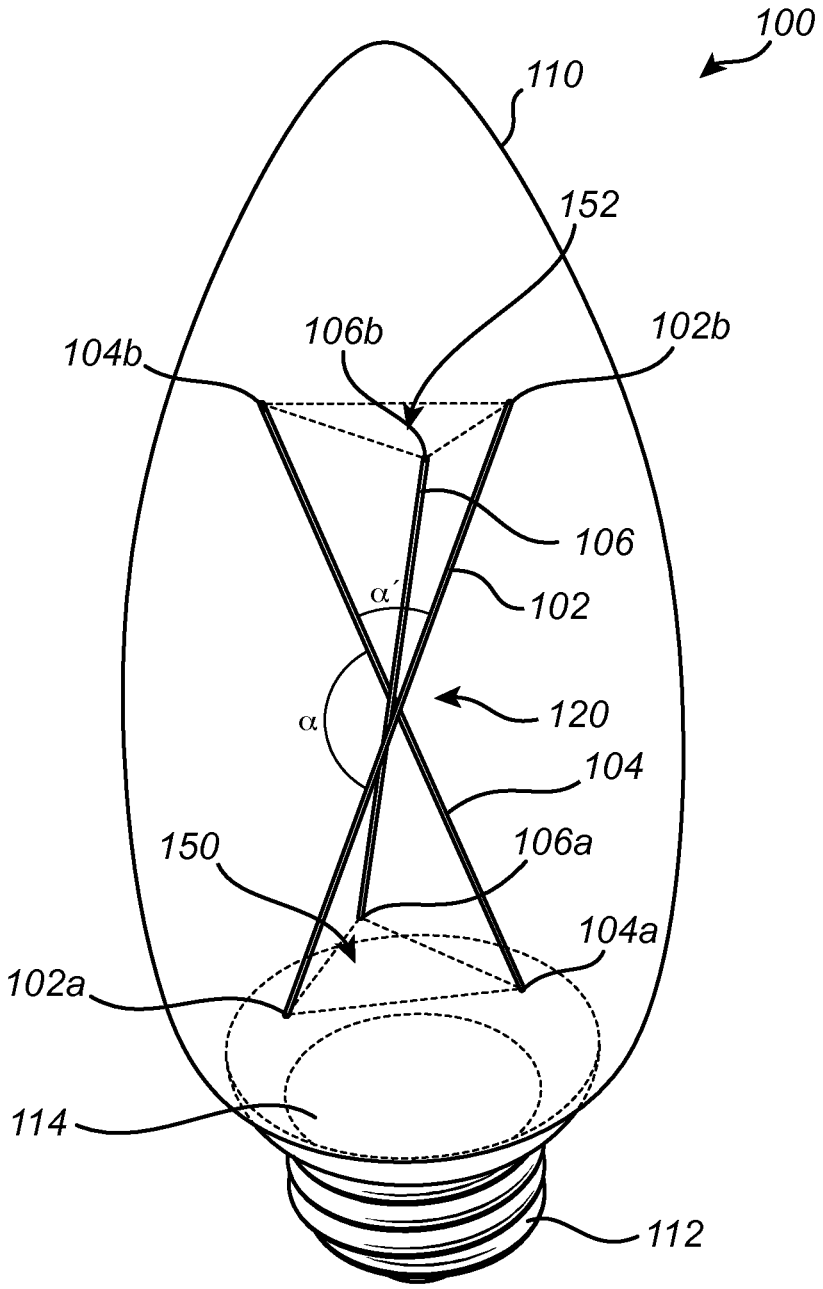
FIG. 1 conceptually illustrates a SSL lamp comprising three elongated elongated light emitting structures arranged in a tripod configuration.

Referring now to the drawings and to FIG. 1 in particular, here is conceptually depicted a SSL lamp 100 according to an embodiment. The SSL lamp 100 comprises three elongated light emitting structures 102, 104, 106. All three light emitting structures 102, 104, 106 are elongated in the sense that their length exceeds three times their width. The light emitting structures 102, 104, 106 are arranged such that their lower ends 102*a*, 104*a*, 106*a*, defines a polygon 150, first polygon 150, in form of a triangle. In other words, a triangle is defined by connecting the respective ends 102*a*, 104*a*, 106*a* by straight lines, as shown in phantom in FIG. 1.

A central portion of each of the light emitting structures 102, 104, 106 are arranged in vicinity of each other such that the three light emitting structures 102, 104, 106 crosses each other.

A common neck 120 is formed where the three light emitting structures 102, 104, 106 crosses each other. As can be seen in FIG. 1, the respective elongated light emitting structures 102, 104, 106 crosses each other in an angled fashion at the common neck 120.

More specifically, the elongated light emitting structures 102 and 104 crosses each other defining two angles, namely angle $\alpha$ and angle $\alpha'$. Angle $\alpha$ and angle $\alpha'$ together amount to 180 degrees. The elongated light emitting structures 102 and 104 crosses each other such that the smallest angle, in the depicted SSL lamp 100 angle $\alpha'$, exceeds 30 degrees. Also the angle $\alpha$ exceeds 30 degrees. In order for the smallest angle of $\alpha$ and $\alpha'$ to exceed 30 degrees the other angle of $\alpha$ and $\alpha'$ cannot exceed 150 degrees as the sum of $\alpha$ and $\alpha'$ is 180 degrees. Any angle of $\alpha$ and $\alpha'$ may be the smallest angle. It is to be understood that corresponding angles are defined where each of the elongated light emitting structures 102, 104, 106 crosses each other, although not explicitly indicated in FIG. 1.

The light emitting structures 102, 104, 106 are arranged such that their upper ends 102*b*, 104*b*, 106*b*, defines another polygon 152, second polygon 152, also in form of a triangle. In other words, the light emitting structures 102, 104, 106 are arranged in a tripod configuration.

In the depicted SSL lamp 100 of FIG. 1, the polygons 150, 152 are of equal shape, although being rotated relative to each other. Moreover, the polygons 150, 152 are of equal size in the depicted SSL lamp 100 of FIG. 1. The polygons 150, 152 are of equal size since the respective light emitting structures 102, 104, 106 crosses each other at a respective center with respect to a longitudinal direction thereof. Further, the light emitting structures 102, 104, 106 are arranged with a corresponding angle with respect to a normal direction of the polygon 150. By crossing the respective light emitting structures 102, 104, 106 at different locations, polygons 150, 152 of different sizes may be achieved. In other words, other ratios between the sizes of the respective polygons 150, 152 may be achieved. Further, the polygons 150, 152 may be tilted with respect to each other.

In the depicted embodiment of FIG. 1, the three light emitting structures 102, 104, 106 are active light emitting structures in form of elongated LED filaments 102, 104, 106. Light is thus generated in and emitted from all three light emitting structures 102, 104, 106. All three light emitting structures 102, 104, 106 are electrically indirectly connected to the socket 112 via a driver, not shown. The socket 112 is used for attaching the SSL lamp 100 to a corresponding fitting, not shown. The elongated LED filaments 102, 104, 106 are mechanically fixed with respect to the socket 112. Various techniques and fixing elements may be used to fix the elongated LED filaments 102, 104, 106 with respect to the socket 112 as is known in the art.

Further, the elongated LED filaments 102, 104, 106 are arranged in a transparent bulb 110. The transparent bulb 110 encloses the elongated LED filaments 102, 104, 106. By enclosing the elongated LED filaments 102, 104, 106 by a bulb, the SSL lamp 100 will resemble the appearance of a conventional incandescent lamp. At the same time the bulb 110 may protect the commonly delicate elongated LED filaments 102, 104, 106 from being brought into contact with external objects, which otherwise may damage the elongated LED filaments 102, 104, 106. Moreover, handling of the SSL lamp 100 may be simplified and the risk of electrical chock may be reduced by employing a bulb 110.

The bulb 110 is at its lower portion employed with an opening 114 through which the elongated LED filaments 102, 104, 106 may be inserted, before the opening 114 is sealed off by the socket 112. The opening 114 has a shape and size, such that the elongated LED filaments 102, 104, 106 may be arranged in their intended positions and electrically connected to the socket 112 and each other, before being inserted into the bulb 110. In other words, the polygons 150 and 152 fit through the opening 114. The LED filaments 102, 104, 106 may be indirectly connected to the socket 112 via a driver, not shown.

The elongated LED filaments 102, 104, 106 of FIG. 1 are all of the same type meaning for instance that they are of equal size and shape, are emitting the same amount of light in terms of light flux, are emitting light having the same color temperature and color distribution. It is however to be noted that different types of elongated LED filaments 102, 104, 106 may be used in the same SSL lamp 100. By using different types of elongated LED filaments 102, 104, 106, the appearance and light distribution of the SSL lamp 100 may thus be tailored. For instance, elongated LED filaments 102, 104, 106, having different lengths and shapes, emitting different amounts of light of different color temperature may be used as an example. Moreover, elongated LED filaments 102, 104, 106 of different colors may be used. Furthermore, light emitting structures comprising solid state lasers may be used as an alternative to elongated LED filaments 102, 104, 106.

Figure 2:
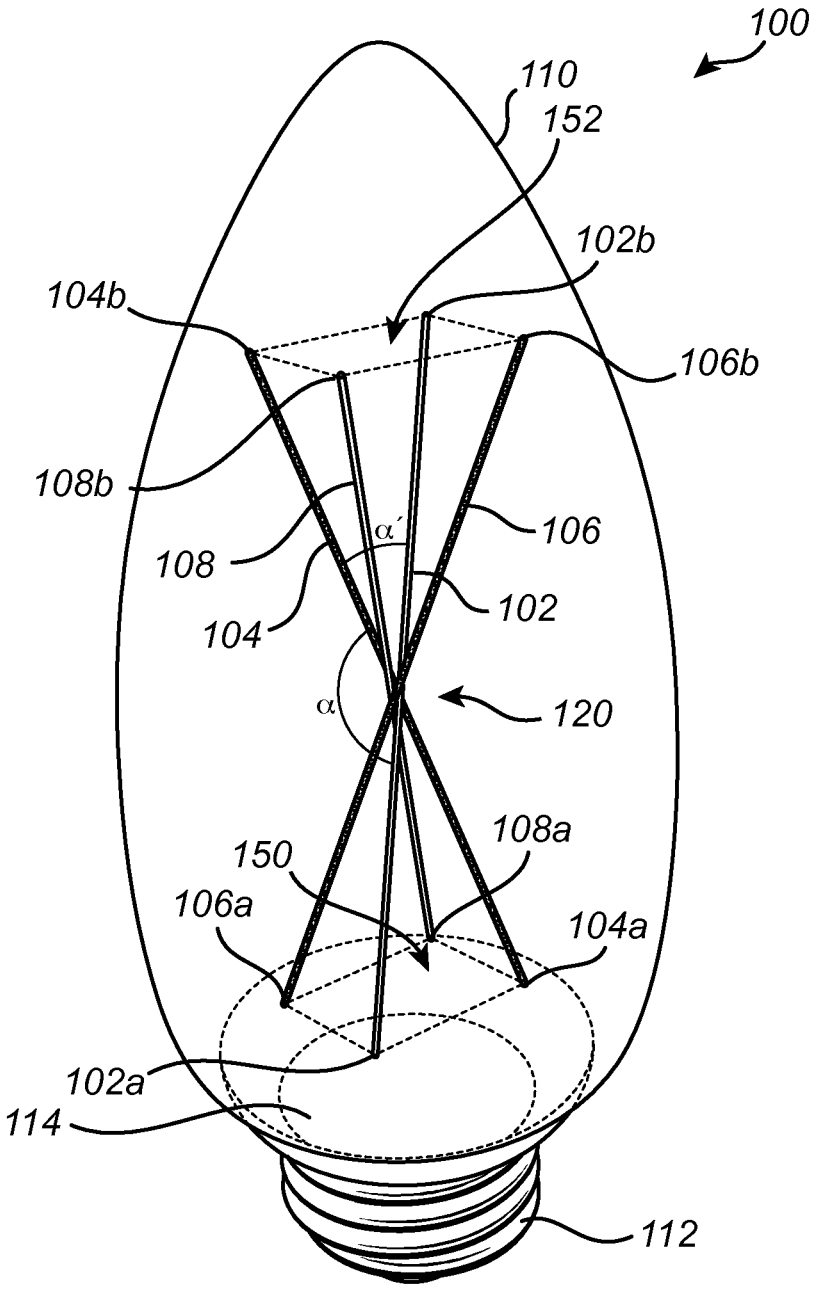
FIG. 2 conceptually illustrates a SSL lamp comprising four elongated elongated light emitting structures arranged in a quadrupod configuration.

Now referring to FIG. 2 here is conceptually depicted a SSL lamp 100 according to another embodiment. The SSL lamp 100 comprises four elongated light emitting structures 102, 104, 106, 108. All four light emitting structures 102, 104, 106, 108 are elongated in the sense that their length exceeds three times their width. The light emitting structures 102, 104, 106, 108 are arranged such that their lower ends 102*a*, 104*a*, 106*a*, 108*a* defines a polygon 150, first polygon 150, in form of a rectangle. In other words, a rectangle is defined by connecting the respective ends 102*a*, 104*a*, 106*a*, 108*a* by straight lines, as shown in phantom in FIG. 2. A central portion of each of the light emitting structures 102, 104, 106, 108 are arranged in vicinity of each other such that the four light emitting structures 102, 104, 106, 108 crosses each other.

A common neck 120 is formed where the four light emitting structures 102, 104, 106, 108 crosses each other. As can be seen in FIG. 2, the respective elongated light emitting structures 102, 104, 106, 108 crosses each other in an angled fashion at the common neck 120.

More specifically, the elongated light emitting structures 102 and 104 crosses each other defining two angles, namely angle $\alpha$ and angle $\alpha'$. Angle $\alpha$ and angle $\alpha'$ together amount to 180 degrees. The elongated light emitting structures 102 and 104 crosses each other such that the smallest angle, in the depicted SSL lamp 100, angle $\alpha'$, exceeds 30 degrees. Also the angle $\alpha$ exceeds 30 degrees. In order for the smallest angle of $\alpha$ and $\alpha'$ to exceed 30 degrees the other angle of $\alpha$ and $\alpha'$ cannot exceed 150 degrees as the sum of $\alpha$ and $\alpha'$ is 180 degrees. Any angle of $\alpha$ and $\alpha'$ may be the smallest angle. It is to be understood that corresponding angles are defined where each of the elongated LED filaments 102, 104, 106, 108 crosses each other, although not explicitly indicated in FIG. 2.

The light emitting structures 102, 104, 106, 108 are arranged such that their upper ends 102*b*, 104*b*, 106*b*, 108*b* define another polygon 152, second polygon 152, also in form of a rectangle. In other words, the light emitting structures 102, 104, 106, 108 are arranged in a quadrupod configuration.

In the depicted SSL lamp 100, the polygons 150, 152 are of equal shape, although being rotated relative to each other. Moreover, the polygons 150, 152 are of equal size in the depicted SSL lamp of FIG. 2. The polygons 150, 152 are of equal size since the respective light emitting structures 102, 104, 106, 108 crosses each other at a respective center with respect to a longitudinal direction thereof. By crossing the respective light emitting structures 102, 104, 106, 108 at different locations, polygons of different sizes may be achieved, as described above in conjunction with FIG. 1. Further, the polygons 150, 152 may be tilted with respect to each other.

In the depicted embodiment of FIG. 2, the four light emitting structures 102, 104, 106, 108 are of two different kinds. More specifically, the light emitting structures 102, 108 are active light emitting structures in form of elongated LED filaments 102, 108 whereas light emitting structures 104, 106 are passive light emitting structures in form of elongated light scattering features 104, 106. The elongated light scattering features 104, 106 are formed of rod shaped elements of a translucent material having a rough surface for scattering of light.

Light is thus generated in and emitted from the light emitting structures 102, 108 whereas no light is generated in the light emitting structures 104, 106. Light generated and emitted by the LED filaments 102, 108 is however impinging on the light scattering features 104, 106. The light impinging on the light scattering features 104, 106 is thus scattered by and conducted within the light scattering features 104, 106. In other words, light will be emitted from the light scattering features 104, 106.

The active light emitting structures 102, 108 are indirectly electrically connected to the socket 112 via a driver, not shown, whereas the passive light emitting structures 104, 106 are not electrically connected to the socket 112. The elongated light emitting structures 102, 104, 106, 108 are mechanically fixed with respect to the socket 112. Various techniques and fixing elements may be used to fix the elongated light emitting structures 102, 104, 106, 108 with respect to the socket 112 as described above in conjunction with FIG. 1.

Further, the elongated LED filaments 102, 108 and the light scattering features 104, 106 of FIG. 2 are arranged in a transparent bulb 110, similarly to what has been described above in conjunction with FIG. 1. The bulb 110 of FIG. 2 is at its lower portion employed with an opening 114 through which the elongated LED filaments 102, 108 and the light scattering features 104, 106 may be inserted, before the opening 114 is sealed off by the socket 112. The polygons 150, 152 fits through the opening 114.

The elongated LED filaments 102, 108 of FIG. 2 are of the same type. However, LED filaments 102, 108 of different types may be used as described in conjunction with FIG. 1 above. The light scattering features 104, 106 of FIG. 2 are of the same type. However, light scattering features 104, 106 of different types may be used. For instance, the size and shape of the light scattering features may be varied. Moreover, the type of light scattering features may be varied.

Also the number of elongated light emitting structures 102, 104, 106, 108 may be varied, in fact any number equal to or greater than three may be used, such as 6, 10 or 23 just to give a few non-limiting examples.

Moreover, the distribution between active light emitting structures and passive light emitting structures among the light emitting structures 102, 104, 106, 108 may be varied. However, in practice at least one of the elongated light emitting structures 102, 104, 106, 108 will have to be an active light emitting structure, or no light will be generated by the SSL lamp 100. For instance, one active light emitting structure, such as a LED filament, may be used with a plurality of passive light emitting structures. Correspondingly, one passive light emitting structure, such as light scattering feature, may be used with a plurality of active light emitting structures. In fact, any number of active light emitting structures may be used with any number of passive light emitting structures, as long as the total number of light emitting structures 102, 104, 106, 108 is equal to or greater than three and at least one light emitting structure is active.

Figure 3:
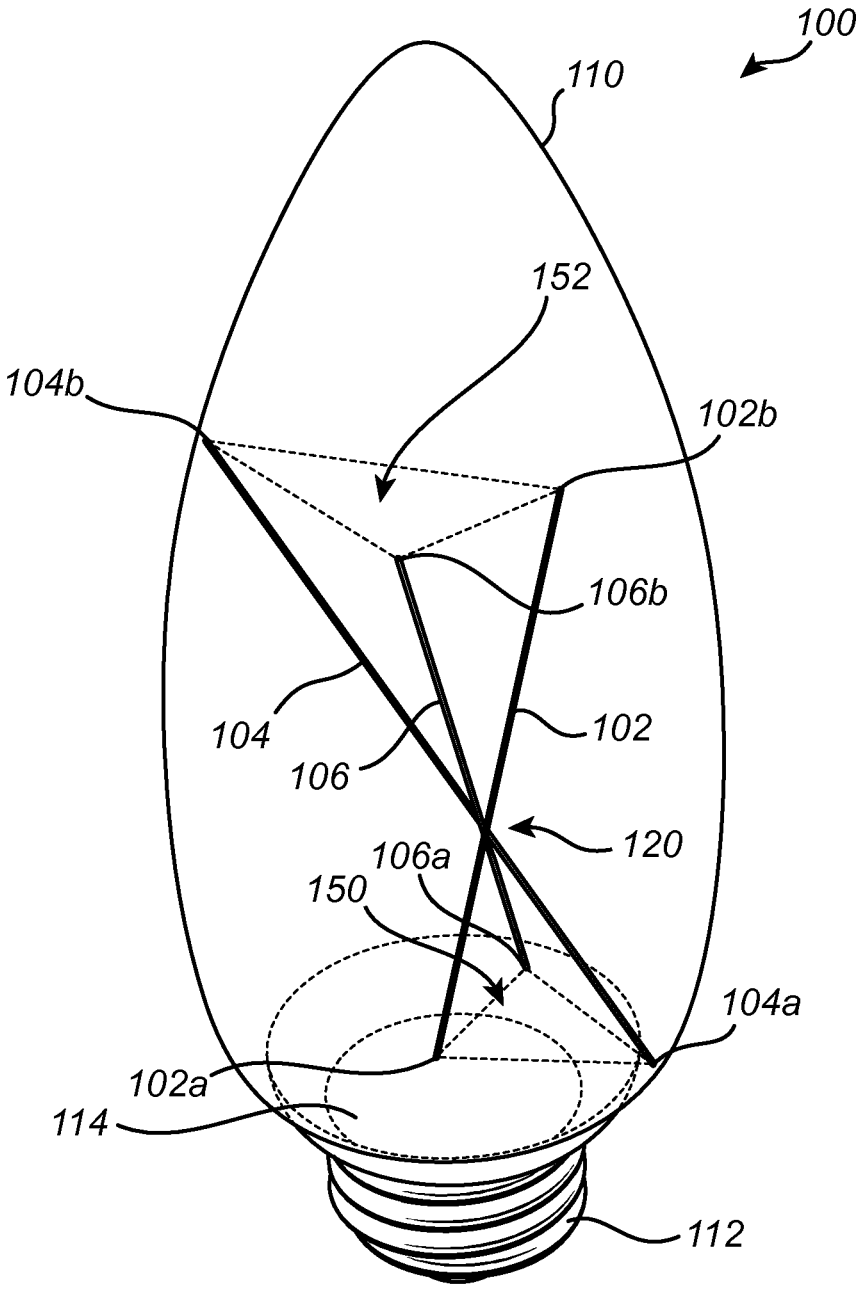
FIG. 3 conceptually illustrates a SSL lamp comprising three elongated elongated light emitting structures arranged differently as compared to FIG. 1.

Now referring to FIG. 3 here is conceptually depicted a SSL lamp 100 according to another embodiment. The SSL lamp 100 of FIG. 3 comprises three elongated light emitting structures 102, 104, 106, just like the SSL lamp 100 of FIG. 1. The three elongated light emitting structures 102, 104, 106 of FIG. 3. are however arranged differently as compared to the three elongated light emitting structures 102, 104, 106 of FIG. 1. As shown in FIG. 3, the three elongated light emitting structures 102, 104, 106 are not symmetrically arranged. Further, the three elongated light emitting structures 102, 104, 106 are not of equal type. As depicted in FIG. 3, the light emitting structure 104 is longer than the light emitting structures 102, 106.

The light emitting structures 102, 104, 106 are arranged such that their lower ends 102*a*, 104*a*, 106*a*, defines a polygon 150, first polygon 150, in form of a triangle, and their upper ends 102*b*, 104*b*, 106*b*, defines a polygon 152, second polygon 152, in form of a triangle. In other words, the light emitting structures 102, 104, 106 are arranged in what may be referred to as a tilted tripod configuration. In the depicted SSL lamp 100 of FIG. 3, the polygons 150, 152 are not of equal shape or size and are being rotated relative to each other. Polygon 150 is smaller than polygon 152. It is to be noted that the first polygon 150 and the second polygon 152 are slightly tilted with respect to each other. In other words, respective planes defined by the first polygon 150 and the second polygon 152 are not parallel. The first polygon 150 and the second polygon 152 may be tilted with any angle with respect to each other.

A non-central portion of each of the light emitting structures 102, 104, 106 are arranged in vicinity of each other such that the three light emitting structures 102, 104, 106 crosses each other. The three light emitting structures 102, 104, 106 crosses each other at a smallest angle of at least 30 degrees as explained above in conjunction with FIG. 1.

A common neck 120 is formed where the three light emitting structures 102, 104, 106 crosses each other. As can be seen in FIG. 3, the respective elongated light emitting structures 102, 104, 106 crosses each other in an angled fashion at the common neck 120.

The elongated light emitting structures 102, 104, 106 are arranged in a transparent bulb 110 employed with an opening 114 as described above in conjunction with FIG. 1. Further, a socket 112 is provided as described above in conjunction with FIG. 1.

In the above the present invention has been exemplified by describing a limited number of embodiments. It is however to be understood that a large number of embodiments and variations may easily be effected by combining what is described for the respective embodiments. Just to give a few more non-limiting examples, it is to be understood that the arrangement of the elongated light emitting structures 102, 104, 106, 108 may be greatly varied irrespective of the general design of the SSL lamp 100 and the bulb 110 used therein. It is to be understood that the shape and size of the bulb 110 and socket 112 may be varied depending on specific needs. Moreover, the bulb 110 and/or socket 112 may be omitted. Moreover, the shape, size, light flux, color temperature, etcetera of the elongated active light emitting features 102, 104, 106, 108 may be varied without departing from the scope of the present inventive concept. Furthermore, the shape, size, extension, orientation, type, opacity, color, width, length etcetera of the passive light emitting features 104, 106 may be varied without departing from the scope of the present inventive concept.

Also the physical dimensions of the SSL lamp 100 may be varied without departing from the scope of the present application. This allows for that the general inventive concept may be used in number of retrofit applications as well as in tailor-made specific applications.

Hence, although the invention has been described with reference to specific exemplifying embodiments thereof, many different alterations, modifications and the like will become apparent for those skilled in the art. Variations to the disclosed embodiments may be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. SSL lamp comprising:

three or more elongated light emitting structures, wherein a respective first end of each of the three or more elongated light emitting structures are arranged such that they define a first polygon, and wherein a portion of each of the three or more elongated light emitting structures are arranged in vicinity of each other such that the three or more elongated light emitting structures crosses each other at a smallest angle ($\alpha$, $\alpha'$) of at least 30 degrees, thereby forming a common neck, and wherein a respective second end of each of the three or more elongated light emitting structures are arranged such that they define a second polygon, the first and second polygons being rotated relative each other.

2. SSL lamp according to claim 1, wherein at least one of the S three or more elongated light emitting structures is an active light emitting structure in the form of an elongated LED filament.

3. SSL lamp (100) according to claim 1, wherein at least one of the three or more elongated light emitting structures is an active light emitting structure in the form of an elongated light emitting structure comprising a solid state laser.

4. SSL lamp according to claim 1, wherein at least one of the three or more elongated light emitting structures is a passive light emitting structure in the form of an elongated light scattering feature.

5. SSL lamp according to claim 1, wherein the three or more elongated light emitting structures are active light emitting structures in the form of elongated LED filaments.

6. SSL lamp according to claim 1, wherein the first polygon and the second polygon are of equal shape.

7. SSL lamp according to claim 1, wherein the first polygon and the second polygon are of equal size.

8. SSL lamp according to claim 1, wherein each of the three or more elongated light emitting structures are arranged with a corresponding angle with respect to a normal direction of the first polygon.

9. SSL lamp according to claim 1, comprising three elongated light emitting structures arranged in a tripod configuration.

10. SSL lamp according to claim 1, comprising four elongated light emitting structures arranged in a quadrupod configuration.

11. SSL lamp according to claim 1, further comprising a transparent bulb configured to at least partially enclose the three or more elongated light emitting structures.

12. SSL lamp according to claim 11, wherein the transparent bulb comprises an opening through which the first polygon fits.

13. SSL lamp according to claim 11, wherein the transparent bulb comprises an opening through which the second polygon fits.

* * * * *